US007954481B2

(12) United States Patent
Barnard

(10) Patent No.: US 7,954,481 B2
(45) Date of Patent: Jun. 7, 2011

(54) BOW STRING VIBRATION SUPPRESSOR

(76) Inventor: Anthony Kirk Barnard, Laguna Hills, CA (US)

( * ) Notice: Subject to any disclaimer, the term of this patent is extended or adjusted under 35 U.S.C. 154(b) by 528 days.

(21) Appl. No.: 12/079,461

(22) Filed: Mar. 26, 2008

(65) Prior Publication Data

US 2008/0236559 A1 Oct. 2, 2008

Related U.S. Application Data

(60) Provisional application No. 60/908,872, filed on Mar. 29, 2007.

(51) Int. Cl.
*F41B 5/20* (2006.01)

(52) U.S. Cl. ..... 124/88; 124/25.6; 124/86; 124/89; 124/90

(58) Field of Classification Search ..... 124/25.6, 124/86, 88, 89, 90
See application file for complete search history.

(56) References Cited

U.S. PATENT DOCUMENTS

| | | | | |
|---|---|---|---|---|
| 4,061,125 | A * | 12/1977 | Trotter | 124/23.1 |
| 4,461,267 | A * | 7/1984 | Simonds et al. | 124/25.6 |
| 4,628,892 | A * | 12/1986 | Windedahl et al. | 124/25.6 |
| 5,339,793 | A * | 8/1994 | Findley | 124/89 |
| 5,390,656 | A * | 2/1995 | Villa et al. | 124/89 |
| 5,452,704 | A * | 9/1995 | Winebarger | 124/92 |
| 5,595,169 | A * | 1/1997 | Brown, Jr. | 124/89 |
| 5,649,527 | A * | 7/1997 | Olsen et al. | 124/89 |
| 5,669,370 | A * | 9/1997 | Breedlove | 124/89 |
| 5,720,269 | A * | 2/1998 | Saunders | 124/86 |
| 6,298,842 | B1 * | 10/2001 | Sims | 124/89 |
| 6,431,163 | B1 * | 8/2002 | Chipman | 124/89 |
| 6,550,467 | B2 * | 4/2003 | Gallops, Jr. | 124/25.6 |
| 6,634,348 | B2 * | 10/2003 | Gallops, Jr. | 124/25.6 |
| 6,675,793 | B1 * | 1/2004 | Saunders | 124/89 |
| 6,684,874 | B2 | 2/2004 | Mizek et al. | 124/89 |
| 6,966,314 | B2 * | 11/2005 | McPherson | 124/89 |
| 7,213,590 | B2 * | 5/2007 | Pellerite | 124/89 |
| D593,181 | S * | 5/2009 | Barnard | D22/107 |
| 7,721,721 | B1 * | 5/2010 | Kronengold et al. | 124/25.6 |
| 7,721,724 | B2 * | 5/2010 | Goade | 124/89 |
| 7,753,044 | B2 * | 7/2010 | Goade | 124/89 |
| 2003/0056779 | A1 * | 3/2003 | Gallops, Jr. | 124/89 |
| 2003/0056780 | A1 * | 3/2003 | Gallops, Jr. | 124/92 |
| 2006/0180135 | A1 * | 8/2006 | Andrews | 124/89 |
| 2006/0278207 | A1 * | 12/2006 | Goade | 124/89 |
| 2006/0283435 | A1 * | 12/2006 | Pellerite | 124/89 |

(Continued)

OTHER PUBLICATIONS

Web Pages from: http://www.archerytalk.com/vb/showthread.php?t=364307&highlight=vibe+killer http://www.archerytalk.com/vb/showthread.php?t=341141&highlight=coolhandluke http://www.archerytalk.com/vb/showthread.php?t=860116.

*Primary Examiner* — Gene Kim
*Assistant Examiner* — Alexander R Niconovich
(74) *Attorney, Agent, or Firm* — David G. Duckworth; Russo & Duckworth, LLP

(57) ABSTRACT

An archery bow string vibration suppressor includes a telescoping arm having a hollow member and an internal slideable elongate shaft. A bumper is affixed to the distal end of the elongate shaft. Furthermore, the vibration suppressor includes a male threaded coupling for affixing the telescoping arm to the rear mounting hole of a bow. In additional embodiments, the vibration suppressor includes an offset adapter bracket for affixing the vibration suppressor to the rear mounting hole of a bow or extension adapter bracket for affixing the vibration suppressor to the front mounting hole of a bow.

6 Claims, 3 Drawing Sheets

U.S. PATENT DOCUMENTS

2008/0092868 A1* 4/2008 Silverson ..... 124/86
2008/0141993 A1* 6/2008 Goade ..... 124/89
2008/0264400 A1* 10/2008 Wright ..... 124/89
2009/0133683 A1* 5/2009 Wright ..... 124/89
2010/0192931 A1* 8/2010 Brewster ..... 124/89
2010/0192932 A1* 8/2010 Brewster ..... 124/89

* cited by examiner

BOW STRING VIBRATION SUPPRESSOR

RELATED APPLICATIONS

This application is a continuation-in-part of U.S. provisional application Ser. No. 60/908,872 filed Mar. 29, 2007.

BACKGROUND OF THE INVENTION

The present invention relates to archery bows. More particularly, the present invention relates to a device for damping the vibration and sound generated in the process of drawing and releasing a bow string.

Archery and bow hunting have long-standing histories and have become increasingly popular sports. This popularity has resulted in increasingly sophisticated bows and arrows.

The bow string on an archery bow is under a great deal of tension. On recurve bows, the bow string is subjected to the entire load imposed by the bow. Compound bows employ tension cables and a mechanical cam construction to reduce the maximum draw force which allows the archer to hold full draw with less exertion. Whether employing a recurve bow or a compound bow, the release of the bow string while under tension causes the bow string to vibrate like a string on a musical instrument. The vibration in turn creates noise. If used while hunting, the noise may alert game birds and animals causing the bow to lose its effectiveness. The vibration generated when the bow string is released further produces a strange vibration to the holder of the bow after the arrow is launched which can cause fatigue in the user of the bow.

Various shock and vibration dampening devices have been developed to minimize shock and vibration. However, previous attempts have been far from successful. In some instances, attachments have been placed upon the bow string directly at various locations in an attempt to dampen bow string vibrations. Though reducing noise, these attachments are largely insufficient for reducing noise from a bow string. Additional devices have been employed which attach directly to the bow's body. The devices are often referred to as "stabilizers". Stabilizers typically are made from lightweight materials and incorporate a fluid, elastomer or granular material to absorb vibration. Representative examples of bow stabilizers are found in U.S. Pat. Nos. 6,675,793 and 7,213,590.

Still additional devices have been developed for reducing bow string vibration which affixed to the bow's body and extend rearwardly to engage the bow string after the bow string is released. These vibration dampening devices include an arm which extend from the bow handle rearwardly and include a resilient member on the rear end of the arm which engages the bow string. For example, U.S. Pat. Nos. 4,061,125; 4,461,267 and 5,720,269 describe vibration dampening devices including an arm positioning a bumper which engages the bow string near the bow string's center point in order to stop the forward progress of the bow string. A similar device is described in U.S. Patent Application No. 2006/0278207 which illustrates a vibration damper including a rearwardly projecting arm affixed to the bow using a mounting block. At the end of the arm is a shock suppressing bumper for engaging the bow string. Unfortunately, each of these arm and bumper constructions suffer from significant disadvantages.

Therefore, there is a significant need for a bow string vibration suppressor which effectively dampens bow string vibration and reduces sound.

There is also a need for an improved bow string vibration suppressor including an arm and bumper configuration which engages the bow string after the bow string is released.

Furthermore, it would be desirable to provide a bow string vibration suppressor including an arm and bumper configuration for engaging a bow string which was adjustable in length for affixing to bows of various configurations and sizes.

Still an additional feature of a desired bow string vibration suppressor would be for the vibration suppressor to affix to either the front or rear mounting stabilizer hole found on many present day compound bows.

BRIEF SUMMARY OF THE INVENTION

Briefly, in accordance with the invention, I provide an improved bow string vibration suppressor. The bow string vibration suppressor includes telescopic arm having a hollow barrel and an elongate shaft. The hollow barrel is tubularly shaped having a cylindrical exterior and a coaxially aligned cylindrical central bore. Meanwhile, the elongate shaft has a circular cross-section sized to be slideably received within the hollow barrel's central bore. The distal extremity of the elongate shaft extends beyond the distal extremity of the hollow barrel. Furthermore, the elongate shaft is telescopically slideable to extend and retract from the hollow barrel to provide the telescopic arm with an adjustable length.

The bow string suppressor includes a resilient elastomeric bumper affixed to the distal end of the elongate shaft for engaging the bow string. Furthermore, the bow string vibration suppressor includes a male threaded coupling which projects rearwardly from the proximal extremity of the hollow barrel. The male threaded coupling is preferably sized and threaded to affix to the front mounting stabilizer hole of a bow.

Because the elongate shaft is slideable within the hollow barrel, the combination has an adjustable length. However, in operation, the elongate shaft must be locked relative to the hollow barrel. Various mechanical structures may be employed to lock the elongate shaft to the hollow barrel. In a preferred embodiment, threaded holes are formed to extend through the hollow barrel's tubular sidewall. Bolts, such as allen bolts, are threadably inserted into the holes. Thereafter, the bolts are tightened until they extend through the tubular sidewall to compressibly engage the elongate shaft and lock the elongate shaft in place. Any number of threaded holes and corresponding threaded bolts may be employed. For example, it has been found that a single threaded hole in the tubular sidewall and corresponding threaded bolt may be employed. However, it is preferred that the vibration suppressor include a pair of holes and a corresponding pair of male threaded bolts.

In a preferred embodiment, the bow string vibration suppressor includes a mechanical construction for preventing the elongate shaft from completely decoupling from the hollow barrel even when the locking bolts are disengaged. To this end, in a preferred embodiment, preferably the elongate shaft includes a longitudinally extending slot which is formed into the side of the elongate shaft. The slot includes a top, a bottom and a pair of end walls. In addition, the vibration suppressor includes a pin which extends laterally into the slot so as to engage and lock to the hollow barrel's tubular sidewalls. Preferably, the tubular sidewall includes a hole through which the pin can extend to position the pin to project into the elongate shaft's slot. Preferably, the hole formed in the tubular sidewall for receiving the pin is sized to provide a press-fit arrangement to lock the pin in place.

In operation, the bow string vibration suppressor is ideal for compound bows which have a front mounting stabilizer hole which is positioned directly behind the bow string. The vibration suppressor's male threaded coupling is threaded to affix the vibration suppressor to the bow's rear mounting stabilizer hole, which in turn causes the telescopic arm to point directly to the bow string. The elongate shaft is extended or retracted so as to position the elastomeric damper adjacent to the bow string, or to engage the bow string to impart additional tension in the bow string if desired by the bow user. Once the elongate shaft is positioned correctly, it is locked in place by tightening the threaded bolts which extend through the threaded holes formed in the hollow barrel's tubular sidewall.

Various modifications of the bow string vibration suppressor can be made to affix to bows of various constructions. For example, bows are not always constructed with the bow string positioned immediately behind the rear mounting hole for a stabilizer. For such a bow, it is preferred that the bow string vibration suppressor of the present invention includes an "offset" adapter bracket for coupling the telescoping arm to the bow's rear mounting hole in offset configuration. The offset adapter bracket includes a female threaded portion for receiving the telescoping arm's threaded coupling and a male threaded portion sized and constructed to affix to the bow's rear mounting stabilizer hole.

Unfortunately, not all bows are constructed with a rear mounting stabilizer hole, but are provided with a front mounting stabilizer hole. For such a bow construction, it is preferred that the bow string vibration suppressor of the present invention include an "extension" adapter bracket constructed for affixing to the front mounting stabilizer hole and for extending around the bow for engaging and positioning the stabilizing arm in position so that the stabilizing arm's bumper engages the bow string. Like the offset adapter bracket, the extension adapter bracket includes a female threaded portion for receiving the vibration suppressor's male coupling. In addition, the adapter bracket includes a male threaded portion for entering and affixing to the front mounting stabilizer hole. Where a stabilizer is intended to be affixed to the bow, the bolt projecting rearwardly from the stabilizer may pass through a hole formed in the bracket to provide the male threaded portion for affixing the extension adapter bracket to the front mounting stabilizer hole.

Thus, it is an object of the present invention to provide an improved bow string vibration suppressor.

It is another object of the present invention to provide a bow string vibration suppressor which is adjustable in length for engaging bow strings.

It is still another object of the present invention to provide a bow string vibration suppressor which can affix to either the front or rear mounting stabilizer hole of a bow.

It is another object of the present invention to provide a bow string vibration suppressor which provides telescopic capabilities which will not unwantingly disassemble.

These and other objects and advantages of the invention will be apparent to those skilled in the art from the following detailed description taken in conjunction with the drawings.

DETAILED DESCRIPTION OF THE INVENTION

Figure 1:
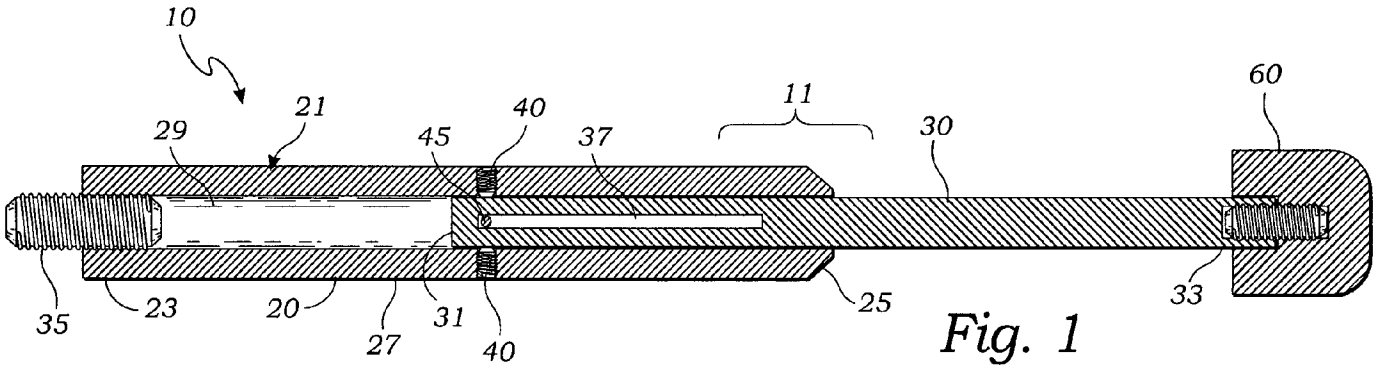
FIG. 1 is a side cutaway of the bow string vibration suppressor of the present invention.

While the present invention is susceptible of embodiments in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-5, the bow string vibration suppressor 10 includes a telescopic arm 11 including a hollow barrel 20 telescopically receiving an internal elongate shaft 30. The hollow member 20 has a tubular sidewall 21 defining a proximal extremity 23, distal extremity 25, cylindrical outer surface 27 and internal cylindrical bore 29. The elongate shaft 30 is cylindrical, preferably solid, and sized to slideably reside within the hollow member's cylindrical bore 29. The elongate shaft 30 also includes a proximal extremity 31 and distal extremity 33. The proximal extremity 31 resides within and is encapsulated by the hollow barrel's cylindrical bore 29 while the elongate shaft's distal extremity 33 projects distally beyond the hollow barrel's distal extremity 25.

The vibration suppressor 10 further includes a resilient elastomeric bumper 60 affixed to the elongate shaft's distal extremity 33. The bumper 60 can be of various configurations and materials as can be selected by those skilled in the art. Furthermore, the bumper 60 can be affixed to the elongate shaft's distal extremity using various constructions such as a press-fit arrangement, or as illustrated in the figures by employing a threaded fastener.

Figure 2:
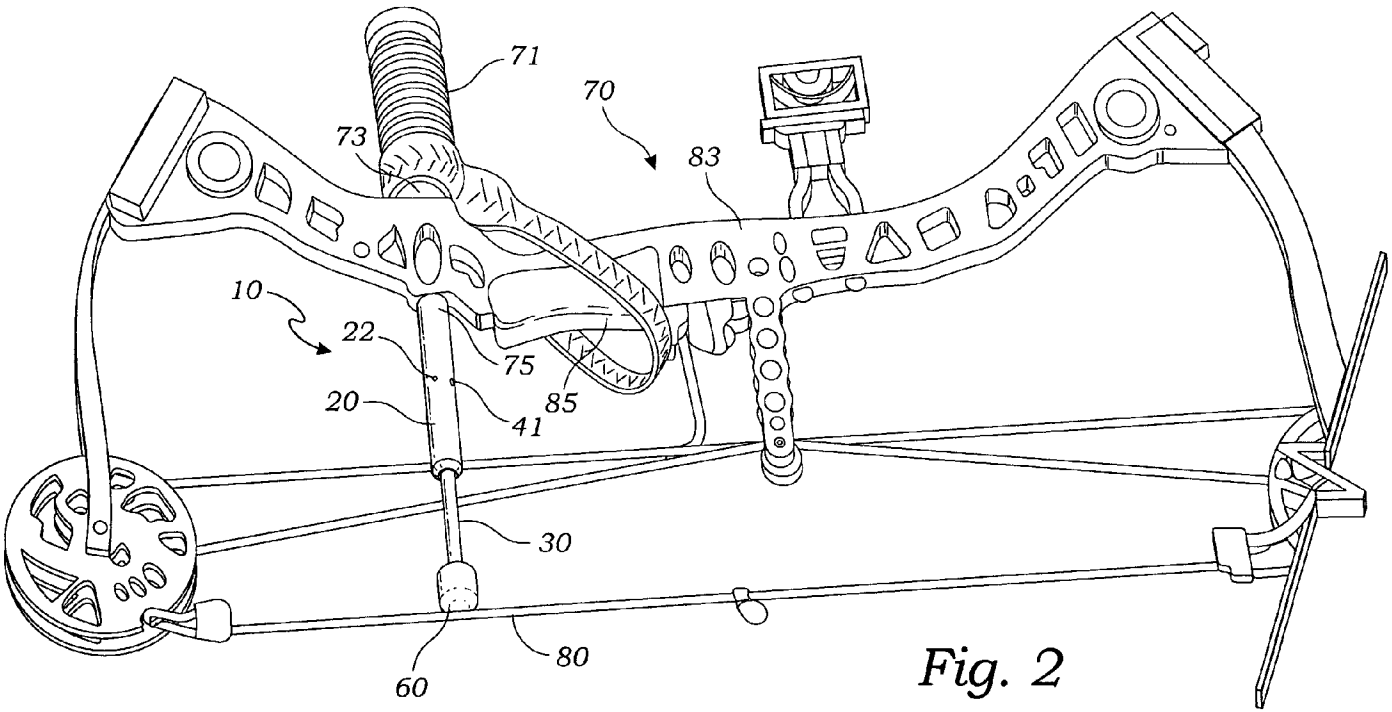
FIG. 2 is a perspective view of a bow employing the bow string vibration suppressor of the present invention.
Figure 3:
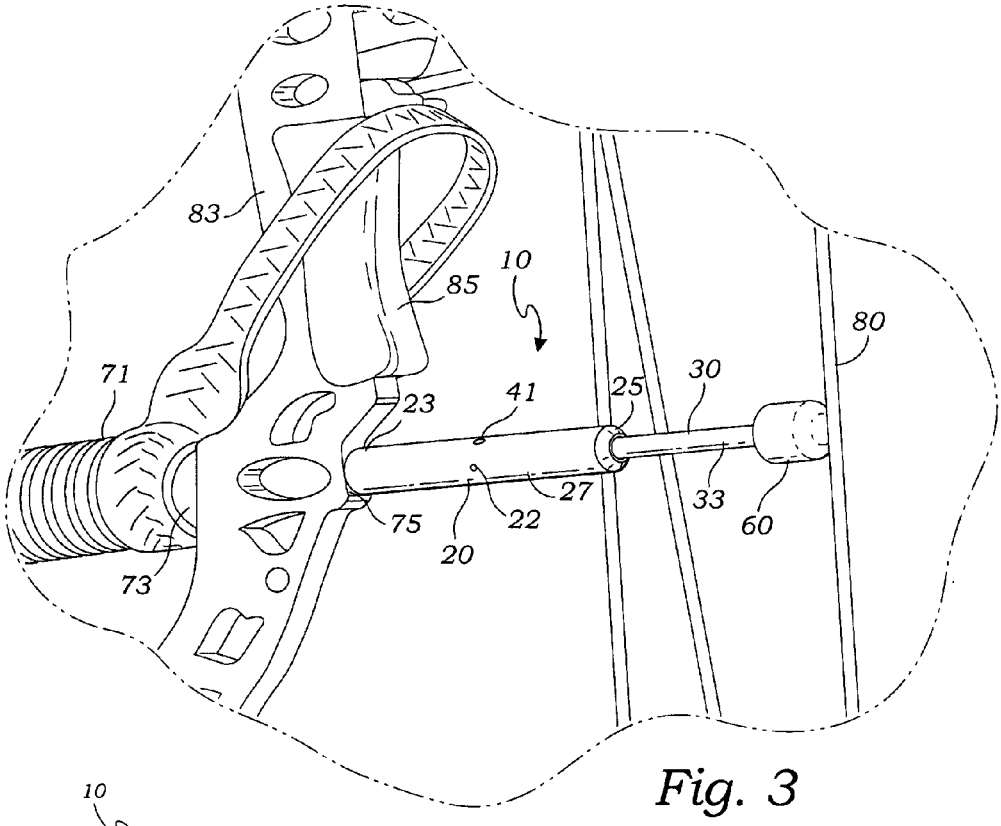
FIG. 3 is a perspective close-up view illustrating the attachment of a bow string vibration suppressor of the present invention to a bow.

As best illustrated in FIGS. 2 and 3, many compound bows 70 include a stabilizer 71. The stabilizer is typically mounted to the front edge of the bow's body 83 below the handle 85. To mount the stabilizer 71 to the bow, the bow typically includes a threaded hole which may project partially into the front of the bow's front edge to form a front mounting hole 73 or the bow may be threaded through its entire body from front to back to form both a front mounting hole 73 and a rear mounting hole 75.

The vibration suppressor 10 of the present invention is ideally suited for affixing to the rear mounting hole 75. To this end, the vibration suppressor includes a threaded coupling 35 which projects from the tubular sidewall's proximal extremity 23. The threaded coupling 35 is constructed to include male threads sized and pitched to affix to the bow's rear mounting hole 75.

Once the bow string vibration suppressor 10 is affixed to the rear mounting hole 75, the elongate shaft 30 is extracted from or retracted into the tubular sidewall 21 by the user until the telescopic arm is of a desired length. Typically, the elongate shaft 30 will be extended until the bumper engages the bow string 80. Once the elongate shaft 30 is extended from the tubular sidewall 21 to a desired length, the elongate shaft 30 and tubular sidewall 21 are locked relative to each other. Preferably, the elongate shaft 30 is locked to the hollow member 20 by providing threaded holes 41 through the hollow member's tubular sidewall and corresponding bolts 40 which project through the tubular sidewall to engage the elongate shaft. Any number of threaded holes 41 and corresponding bolts 40 may be utilized. However, as illustrated in the figures, two sets of bolts and corresponding holes are sufficient.

Figure 4:
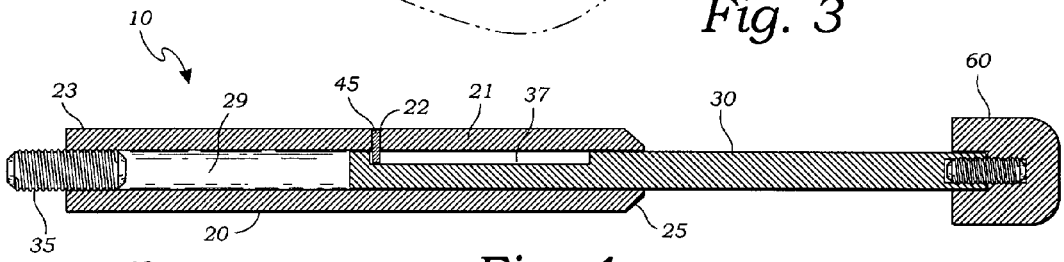
FIG. 4 is a side cutaway view illustrating the bow string vibration suppressor of the present invention in a telescopically extended position.
Figure 5:
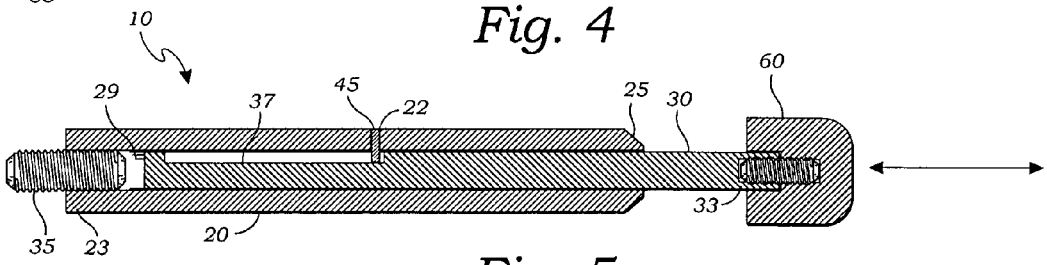
FIG. 5 is a side cutaway view illustrating the bow string vibration suppressor of the present invention in a telescopically retracted condition.

Preferably the vibration suppressor 10 is constructed so that the elongate shaft 30 does not completely disengage from the hollow member 20 when the bolts 40 are not properly tightened. Various constructions may be employed. However, as illustrated in FIGS. 1, 3 and 4, preferably the elongate shaft 30 is formed with a longitudinally extending slot 37 which forms a depression in one side of the elongate shaft 30. In addition, a pin 45 is provided which extends into the slot 37 from a hole 22 formed in the hollow member's tubular sidewall 21. Preferably the pin 45 is maintained in place by a press-fit engagement between the pin and holes 22 formed in the tubular sidewall 21. As illustrated in FIGS. 1, 4 and 5, the pin 45 and slot 37 construction allows the elongate shaft 30 to telescopically slide within the hollow member 20 from a retracted condition (FIG. 5) to an extended position (FIG. 4) without allowing the combination to decouple.

Figure 6A:
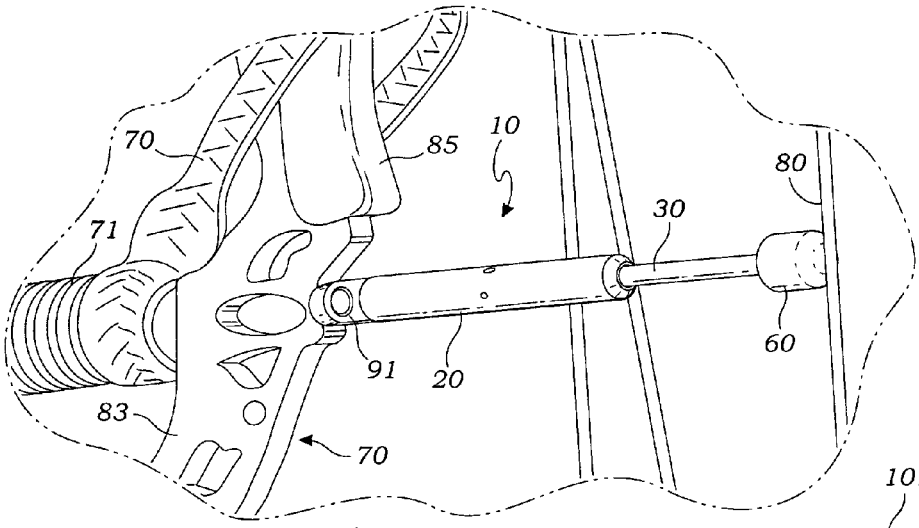
FIG. 6A is a close-up perspective view illustrating the bow string vibration suppressor including an offset adapter for affixing to the rear mounting stabilizer hole of a bow.
Figure 6B:
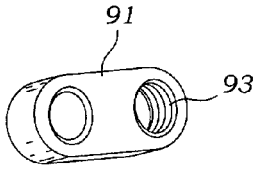
FIG. 6B is a perspective view illustrating an offset adapter for mounting a bow string vibration suppressor of the present invention to a bow where the bow string is offset to the mounting hole.

Many bows are constructed with the rear mounting stabilizer hole 75 offset laterally relative to the bow string 80. Accordingly, as illustrated in FIGS. 6*a* and 6*b*, in an additional embodiment of the invention, the bow string vibration suppressor 10 includes an offset adapter bracket 91. The offset adapter bracket 91 includes a female threaded portion 93 constructed for receiving the vibration suppressor's threaded coupling 35. The offset adapter bracket 91 further includes a male threaded portion (not shown) for affixing the offset adapter bracket to the bow's rear mounting hole 75. The male threaded portion preferably takes the form of a threaded bolt which passes through a hole formed in the bracket. The offset adapter bracket extends horizontally relative to the bow's vertical plane so as to position the telescoping arm 11 to be positioned immediately in front of the bow string 80.

Figure 7B:
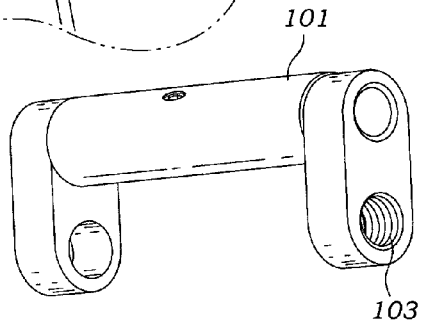
FIG. 7B is a perspective view of an extension adapter bracket for affixing the bow string vibration suppressor to the front mounting stabilizer hole of a bow.
Figure 7A:
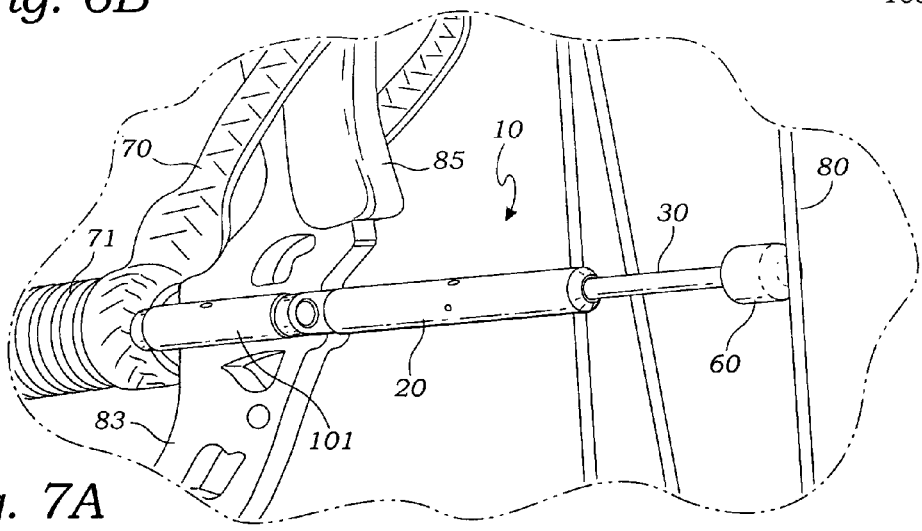
FIG. 7A is a close-up perspective view illustrating the bow string vibration suppressor of the present invention employing an extension adapter bracket for affixing to the front mounting stabilizer hole of a bow.

Unfortunately, some bows are constructed without a rear mounting stabilizer hole. Accordingly, in still an additional preferred embodiment of the invention, the vibration suppressor 10 is constructed with an extension adapter bracket 101 illustrated in FIGS. 7*a* and 7*b*. Like the offset adapter bracket 91 illustrated in FIGS. 6*a* and 6*b*, the extension adapter bracket 101 includes a female threaded portion 103 for receiving the vibration suppressor's threaded coupling 35. In addition, the extension adapter bracket 101 includes a male threaded portion for affixing to the front mounting hole 73. As illustrated in FIG. 7*a*, the male threaded portion may employ the male bolt (not shown) projecting from the rear of a stabilizer passing through a hole formed in the extension adapter bracket. Thus, the extension adapter bracket 101 is affixed to the bow body 83 by positioning the extension bracket's hole (not shown) immediately adjacent to the bow's front mounting hole 73 and causing the stabilizer's 71 bolt to project through the extension bracket's hole into the front mounting hole 73 until the stabilizer, extension adapter bracket 101 and bow are affixed to one another. Advantageously, the extension adapter bracket 101 is constructed to wrap around the bow's body 83 so as to position the vibration suppressor's telescopic arm 11 and bumper 60 immediately in front of the bow string 80.

The various components of the vibration suppressor may be manufactured from materials that can be selected by those skilled in the art including metals, plastics, ceramics and rubbers. However, aluminum has been found to be a preferred material for the hollow tubular member 20, elongate shaft 30, threaded coupling 35, bolts 40, locking pin 45, as well as the offset adapter bracket 91 and extension adapter bracket 101. Preferably, the bumper 60 is made of a more resilient material such as a natural or synthetic rubber.

While several particular forms of the invention have been illustrated and described, it will be apparent that various modifications can be made without departing from the spirit and scope of the invention. Therefore, it is not intended that the invention be limited except by the following claims. Having described my invention in such terms so as to enable persons skilled in the art to understand the invention, recreate the invention and practice it, and having identified the presently preferred embodiments thereof.

I claim:

1. A bow with bow string vibration suppressor comprising:

a body and a bowstring, said body including a mounting hole extending from the front of said body through to the rear of said body for horizontally affixing a stabilizer, said mounting hole being positioned behind and laterally offset to said bowstring;

a hollow barrel forming a tubular sidewall, a proximal extremity, a distal extremity, a substantially cylindrical exterior and a substantially cylindrical central bore defining the barrel's longitudinal axis;

a male threaded coupling projecting proximally from said hollow barrel's proximal extremity, said male threaded coupling having a central axis coaxially aligned with said hollow barrel's longitudinal axis;

an offset adapter bracket for positioning said hollow barrel immediately behind said bow string, said offset adapter bracket including a male threaded portion threadably affixed to the rear mounting stabilizer hole of said bow and a female threaded portion threadably receiving said male threaded coupling;

an elongate shaft having a proximal extremity and a distal extremity, said elongate shaft having an elongate cylindrical shape and positioned within and coaxially aligned with said hollow barrel so as to be telescopically slideable within said hollow barrel to provide an adjustable length for said hollow barrel and elongate shaft combination, said hollow barrel receiving and encapsulating said elongate shaft's proximal extremity, said elongate shaft extending distally beyond the hollow barrel's distal extremity;

locking means for locking said elongate shaft to said hollow barrel so as to prevent said elongate shaft from telescopically sliding relative to said hollow barrel; and an elastomeric damper affixed to the distal end of said elongate shaft for engaging and dampening the vibration of said bow string.

2. The bow string vibration suppressor of claim 1 further comprising:

a slot extending laterally across said elongate shaft; and a pin having first and second ends, said first end of said pin engaging said hollow barrel's tubular sidewall and said second end of said pin projecting into said slot so that said second end engages one of said slot end walls when said elongate shaft is in an extended position so as to prevent removal of said elongate shaft from said tubular barrel.

3. The bow string vibration suppressor of claim 1 wherein said locking means comprises:

a pair of female threaded holes extending laterally through said hollow barrel's tubular sidewall; and a pair of male threaded bolts extending through said female threaded holes to compressibly engage said elongate shaft.

4. A bow with bow string vibration suppressor comprising:

a body and a bowstring, said body including a mounting hole on the front of said body for horizontally affixing a stabilizer;

a hollow barrel forming a tubular sidewall, a proximal extremity, a distal extremity, a substantially cylindrical exterior and a substantially cylindrical central bore defining the barrel's longitudinal axis;

a male threaded coupling projecting proximally from said hollow barrel's proximal extremity, said male threaded coupling having a central axis coaxially aligned with said hollow barrel's longitudinal axis;

an extension adapter bracket mounting to said bow's front mounting stabilizer hole and for extending around the bow from said front mounting stabilizer hole to the rear of said bow for positioning said hollow barrel immediately behind said bow string, said extension adapter bracket including a male threaded portion threadably affixing to the front mounting stabilizer hole of a bow and a female threaded portion threadably receiving said male threaded coupling;

an elongate shaft having a proximal extremity and a distal extremity, said elongate shaft having an elongate cylindrical shape and positioned within and coaxially aligned with said hollow barrel so as to be telescopically slideable within said hollow barrel to provide an adjustable length for said hollow barrel and elongate shaft combination, said hollow barrel receiving and encapsulating said elongate shaft's proximal extremity, said elongate shaft extending distally beyond the hollow barrel's distal extremity;

locking means for locking said elongate shaft to said hollow barrel so as to prevent said elongate shaft from telescopically sliding relative to said hollow barrel; and an elastomeric damper affixed to the distal end of said elongate shaft for engaging and dampening the vibration of said bow string.

5. The bow string vibration suppressor of claim 4 further comprising:

a slot extending laterally across said elongate shaft; and a pin having first and second ends, said first end of said pin engaging said hollow barrel's tubular sidewall and said second end of said pin projecting into said slot so that said second end engages one of said slot end walls when said elongate shaft is in an extended position so as to prevent removal of said elongate shaft from said tubular barrel.

6. The bow string vibration suppressor of claim 4 wherein said locking means comprises:

a pair of female threaded holes extending laterally through said hollow barrel's tubular sidewall; and a pair of male threaded bolts extending through said female threaded holes to compressibly engage said elongate shaft.

* * * * *